US012723753B2

(12) United States Patent
Yan et al.

(10) Patent No.: US 12,723,753 B2
(45) Date of Patent: Sep. 1, 2026

(54) BURNER FOR FUEL COMBUSTION AND COMBUSTION METHOD THEREFOR

(71) Applicant: L'Air Liquide, Société Anonyme pour l'Etude et l'Exploitation des Procédés Georges Claude, Paris (FR)

(72) Inventors: Tao Yan, Shanghai (CN); Remi Tsiava, Saint Germain-les-Corbeil (FR); Shenqi Xu, Shanghai (CN); Peter Van Kampen, Shanghai (CN); Ting Zhang, Shanghai (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 623 days.

(21) Appl. No.: 17/790,394

(22) PCT Filed: Dec. 29, 2020

(86) PCT No.: PCT/CN2020/140489

§ 371 (c)(1),
(2) Date: Jun. 30, 2022

(87) PCT Pub. No.: WO2021/136218

PCT Pub. Date: Jul. 8, 2021

(65) Prior Publication Data

US 2023/0043686 A1 Feb. 9, 2023

(30) Foreign Application Priority Data

Dec. 31, 2019 (CN) ..... 201911406670.2

(51) Int. Cl.

| | |
|---|---|
| ***F23D 14/02*** | (2006.01) |
| ***F23C 5/14*** | (2006.01) |
| ***F23D 14/22*** | (2006.01) |
| ***F23D 14/32*** | (2006.01) |
| ***F23D 17/00*** | (2006.01) |
| ***F23N 1/02*** | (2006.01) |

(52) U.S. Cl.
CPC ..... *F23D 14/22* (2013.01); *F23C 5/14* (2013.01); *F23D 14/02* (2013.01); *F23D 14/32* (2013.01);
(Continued)

(58) Field of Classification Search
CPC ..... F23D 14/22; F23D 14/02; F23D 14/32; F23D 17/00; F23C 5/14; F23C 2900/06041; F23N 1/02; F23M 2900/05021
(Continued)

(56) References Cited

U.S. PATENT DOCUMENTS 5,413,476 A * 5/1995 Baukal, Jr. ..... F23L 7/007 431/351
5,611,682 A 3/1997 Slavejkov et al.
(Continued)

FOREIGN PATENT DOCUMENTS

BR 9 705 062 5/1999
CN 1134610 C 1/2004
(Continued)

OTHER PUBLICATIONS

2019.*
(Continued)

*Primary Examiner* — Avinash A Savani
(74) *Attorney, Agent, or Firm* — Allen E. White; Elwood L. Haynes

(57) ABSTRACT

Disclosed are a combustor for fuel combustion and a combustion method therefor. The combustor includes a primary oxidant-fuel delivery assembly, a secondary oxidant delivery assembly, and a tertiary oxidant delivery assembly. The secondary oxidant delivery assembly and the tertiary oxidant delivery assembly are provided on the same side of the primary oxidant-fuel delivery assembly, and the secondary
(Continued)

oxidant delivery assembly is located between the tertiary oxidant delivery assembly and the primary oxidant-fuel delivery assembly. The present invention combines the staged combustion and dilution combustion technologies, such that the combustor has a wide flame adjusting range, realizing adjustment of the flame combustion position, flame speed range, flame local atmosphere and flame length, effectively reducing the generation of NOx, and also achieving high heat transfer efficiency.

19 Claims, 7 Drawing Sheets

(52) U.S. Cl.
CPC ..... *F23D 17/00* (2013.01); *F23N 1/02* (2013.01); *F23C 2900/06041* (2013.01); *F23M 2900/05021* (2013.01)

(58) Field of Classification Search
USPC ..... 431/187
See application file for complete search history.

(56) References Cited

U.S. PATENT DOCUMENTS

| | | | | |
|---|---|---|---|---|
| 6,074,197 | A | 6/2000 | Philippe | |
| 2007/0172781 | A1 | 7/2007 | Tsiava et al. | |
| 2010/0068665 | A1 | 3/2010 | Leroux et al. | |
| 2010/0086886 | A1* | 4/2010 | Johnson | F23N 5/102 431/72 |
| 2011/0104625 | A1 | 5/2011 | Amirat et al. | |
| 2011/0142739 | A1 | 6/2011 | Swanson et al. | |
| 2014/0011141 | A1* | 1/2014 | Matsumoto | F23D 1/005 431/12 |
| 2018/0038590 | A1 | 2/2018 | Yamamoto et al. | |
| 2018/0237323 | A1 | 8/2018 | D'Agostini et al. | |

FOREIGN PATENT DOCUMENTS

| | | |
|---|---|---|
| CN | 104285100 | 1/2015 |
| CN | 107250669 | 10/2017 |
| CN | 108458339 | 10/2019 |
| CN | 109489038 | 12/2019 |
| EP | 0 844 433 | 11/1997 |
| JP | S52 74926 | 6/1977 |
| JP | H10 238711 | 9/1998 |
| JP | 2002 303406 | 10/2002 |
| JP | 2008 527292 | 7/2008 |
| WO | WO 2013 097165 | 7/2013 |

OTHER PUBLICATIONS

International Search Report for corresponding PCT/CN2020/140489, Feb. 18, 2021.
Brazil Written Opinion for BR 112022011411-7, mailed Jan. 13, 2025.

* cited by examiner

BURNER FOR FUEL COMBUSTION AND COMBUSTION METHOD THEREFOR

CROSS REFERENCE TO RELATED APPLICATIONS

This application is a 371 of International Application No. PCT/CN2020/140489, filed Dec. 29, 2020, which claims priority to Chinese Patent Application No. 2019114056670.2, filed Dec. 31, 2019, the entire contents of which are incorporated herein by reference.

TECHNICAL FIELD

The present invention relates to a burner for fuel combustion and a combustion method, in particular to a burner which is capable of producing a staged flame with a multi-stage configuration, and which has lower NOx emissions when used in an industrial melting furnace.

BACKGROUND ART

It is known in the art that in an industrial melting furnace, compared with conventional air combustion (e.g. for metallurgy or the glass industry), oxy-fuel combustion has lower investment costs, higher combustion efficiency, lower NOx emissions and higher product quality.

In the prior art, a common staged oxygen-fuel burner has a fuel channel and an oxidant channel, and uses oxygen staging to divert a portion of the oxygen from the flame and thus delay combustion. A nozzle end of the burner produces a substantially flat fuel-rich flame, a staging nozzle introduces a portion of oxidant from below the fuel-rich flame, and a fuel-lean flame is produced that entrains a lower part of the fuel-rich flame.

Chinese patent no. CN1134610C has disclosed a typical staged burner. As shown in FIG. 1A, the staged oxygen-containing fuel burner can produce a substantially flat flame having a fuel-rich flame zone and a fuel-lean flame zone. A fuel channel of the burner terminates at a nozzle. In addition, a similar staged burner may also be as shown in FIG. 1B; a secondary oxidant or staged oxidant still takes part in staged combustion distant from the fuel-primary oxidant. A limitation of this type of burner is that flexible adjustment of the oxygen distribution and flame shape is very difficult, while it is also very difficult to attain a required oxidation atmosphere or reduction atmosphere, etc. in a specific region.

A double-staged oxygen-fuel burner as shown in FIG. 2 has also been disclosed in the prior art. Chinese patent CN108458339B has expounded that the oxygen-fuel burner comprises a central conduit and an annular conduit, wherein the fuel is ejected from the central conduit, and the oxidant is ejected from an upper conduit and a lower conduit. However, a shortcoming of this staged burner is that it has major limitations when adjusting an atmosphere at the surface of the melting raw material, and the range of adjustment of the flame is limited. If the method of reducing or shutting down the oxidant ejection amount in a lower layer is employed, then the oxidant will be concentrated in a middle layer and an upper layer, and consequently, the method of adjustment of oxidant staged combustion is restricted.

FIG. 3 is a schematic drawing of the ejection states of fuel and oxygen in another dilute oxygen combustion (DOC) burner in the prior art, wherein the fuel and oxygen are ejected from independent ejection outlets. A dilute oxygen burner can avoid the occurrence of local high-temperature points and at the same time produce a more uniform temperature distribution; however, to achieve a better reduction atmosphere, the oxygen and fuel ejection outlets need to be kept at quite a large distance from each other, so as to ensure that after the oxygen and fuel have been ejected at high speed to mix and burn, the waste gases resulting from combustion can be entrained in the oxidant and fuel streams, so that they can then react with the fuel/oxygen separately. This form of combustion with dilute oxygen requires the ejection speeds of the fuel and oxidant to be extremely high, and also requires a more complex control process; due to these factors, its use in industry is more difficult to achieve.

Based on the discussion above, the market needs a more efficient burner and combustion method to overcome these shortcomings. There is a desire to minimize the average speed difference between the fuel stream and oxidant stream when initial mixing takes place. There is also a desire to improve melting furnace performance by operating a burner with higher momentum and a greater number of stages, so as to produce a longer fuel-rich flame that is also stable. Further, there is a desire to increase the total heat transfer rate, improve melting furnace performance, reduce defects in glass, and increase output. At the same time, it is possible to flexibly control that atmosphere in a specific local region, increase the adjustability of the atmosphere, and reduce emissions of nitrogen oxides (NOx).

SUMMARY OF THE INVENTION

The present invention hopes to solve the following technical problems in the prior art: the range of adjustment of flame rigidity, flame length and coverage region is narrow; the range of adjustment of flame combustion position and speed is limited; there is limited room for adjustment of atmosphere in parts of the flame, so the control of a specific atmosphere in a specific region is very difficult; it is very difficult to adapt to process demands by changing the heat transfer coefficient (radiation and convection); the oxygen concentration cannot be conveniently adjusted, the ignition temperature limit adaptability is poor, local flame temperatures are too high, and so on.

An object of the present invention is to combine the technologies of staged and dilute combustion, so that the burner has a broader range of flame adjustment, enabling the adjustment of flame combustion position, flame speed range, flame local atmosphere and flame length, and it is also possible to effectively reduce the production of NOx while achieving higher heat transfer efficiency.

To achieve the above object, in a first aspect of the present invention, a burner for fuel combustion is provided, wherein the burner comprises a burner body extending in an axial direction, and a flame for heating a material being heated is formed at a front end face of the burner body, the burner body comprising: a primary oxidant-fuel delivery component, a secondary oxidant delivery component and a tertiary oxidant delivery component;

the secondary oxidant delivery component and tertiary oxidant delivery component are arranged at the same side of the primary oxidant-fuel delivery component, and the secondary oxidant delivery component is located between the tertiary oxidant delivery component and the primary oxidant-fuel delivery component;

the primary oxidant-fuel delivery component comprises:

at least one fuel supply channel for a fuel to flow through, one end thereof being provided with a fuel nozzle; and at least one primary oxidant supply channel for a primary oxidant to flow through, the primary oxidant supply channel being configured to surround an outer wall of the fuel supply channel, and one end thereof being provided with an annular nozzle surrounding the fuel nozzle;

the secondary oxidant delivery component comprises at least one secondary oxidant supply channel for a secondary oxidant to flow through, one end thereof being provided with a secondary oxidant nozzle;

the tertiary oxidant delivery component comprises at least one tertiary oxidant supply channel for a tertiary oxidant to flow through, one end thereof being provided with a tertiary oxidant nozzle. This configuration may be such that the primary oxidant-fuel delivery component is located between the secondary oxidant delivery component and a melting surface of a material being heated, and the tertiary oxidant delivery component is located between the secondary oxidant delivery component and the top of a melting furnace.

Further, in at least one primary oxidant-fuel delivery component, the primary oxidant supply channel is arranged coaxially with the fuel supply channel.

Further, outlet ends of the secondary oxidant nozzle and the tertiary oxidant nozzle are arranged on the front end face of the burner body and spray the secondary oxidant and tertiary oxidant respectively, and the secondary oxidant mixes with the fuel before the tertiary oxidant.

Further, at least one said fuel nozzle sprays the fuel in the axial direction of the burner body.

Further, a front end of at least one said fuel nozzle has a first oblique flow path inclined toward the secondary oxidant nozzle.

Further, at least one fuel nozzle and the annular nozzle surrounding said fuel nozzle are provided with a first horizontal spread angle $\alpha_1$ of deviation toward the outside of the burner body, the first horizontal spread angle $\alpha_1$ being in the range of 0-20°, preferably 0-10°, and more preferably 3°-6°. Due to the first horizontal spread angle $\alpha_1$, the fuel sprayed from the fuel nozzle and the primary oxidant sprayed from the annular nozzle both spread toward the outside of the burner body. The first horizontal spread angle $\alpha_1$ refers to the angle between the central axis of the fuel nozzle and the axial direction of the burner body; the outside of the burner body means away from the center of the burner body.

Further, the fuel supply channel is arranged to be coaxial with the fuel nozzle at the end thereof, and has the first horizontal spread angle $\alpha_1$.

Further, at least one said secondary oxidant nozzle sprays the secondary oxidant in the axial direction of the burner body.

Further, a front end of at least one said secondary oxidant nozzle has a second oblique flow path inclined toward the fuel nozzle. The spraying direction of oxidant can be changed by the oblique flow path for oxidant, to flexibly change the flame shape according to the furnace shape and the characteristics of the material being heated.

Further, at least one said secondary oxidant nozzle is provided with a second horizontal spread angle $\alpha_2$ of deviation toward the outside of the burner body, the second horizontal spread angle $\alpha_2$ being in the range of 0-15°, preferably 0-10°, and more preferably 3°-8°. Due to the second horizontal spread angle $\alpha_2$, the secondary oxidant sprayed from the secondary oxidant nozzle spreads toward the outside of the burner body. The second horizontal spread angle $\alpha_2$ refers to the angle between the central axis of the secondary oxidant nozzle and the axial direction of the burner body, when the secondary oxidant nozzle is projected onto the XY plane in which the primary oxidant-fuel delivery component lies.

Further, at least one said secondary oxidant supply channel is arranged to be coaxial with the secondary oxidant nozzle at the end thereof, and has the second horizontal spread angle $\alpha_2$.

Further, at least one said tertiary oxidant nozzle sprays the tertiary oxidant in the axial direction of the burner body.

Further, a front end of at least one said tertiary oxidant nozzle has a third oblique flow path inclined toward the fuel nozzle.

Further, at least one said tertiary oxidant nozzle is provided with a third horizontal spread angle $\alpha_3$ of deviation toward the outside of the burner body, the third horizontal spread angle $\alpha_3$ being in the range of 0-15°, preferably 2°-10°, and more preferably 4°-10°. Due to the third horizontal spread angle $\alpha_3$, the tertiary oxidant sprayed from the tertiary oxidant nozzle spreads toward the outside of the burner body. The third horizontal spread angle refers to the angle between the central axis of the tertiary oxidant nozzle and the axial direction of the burner body, when the tertiary oxidant nozzle is projected onto the XY plane in which the primary oxidant-fuel delivery component lies.

Further, at least one said tertiary oxidant supply channel is arranged to be coaxial with the tertiary oxidant nozzle at the end thereof, and has the third horizontal spread angle $\alpha_3$.

Further, at least one said fuel nozzle is provided with a first perpendicular angle $\beta_1$ of deviation toward the secondary oxidant nozzle, the angle $\beta_1$ being in the range of 0-10°, preferably 0-3°. The first perpendicular angle $\beta_1$ refers to the angle between the central axis of the fuel nozzle and the axial direction of the burner body, when the fuel nozzle is projected onto the XZ plane.

Further, at least one said primary oxidant-fuel delivery component further comprises: a first adjusting connection member, used to connect the fuel supply channel to the fuel nozzle thereof, and capable of adjusting the fuel nozzle to have the first horizontal spread angle $\alpha_1$ and/or the first perpendicular angle $\beta_1$ as required. The first adjusting connection member may comprise but is not limited to a universal joint, a corrugated pipe or a similar connection mechanism; these allow the fuel supply channel to be attached to the fuel nozzle, and can rotate within a certain range so as to allow the fuel nozzle to have a preferred or default first horizontal spread angle $\alpha_1$ and/or first perpendicular angle $\beta_1$.

Further, at least one said secondary oxidant nozzle is provided with a second perpendicular angle $\beta_2$ of deviation toward the primary oxidant-fuel delivery component, the angle $\beta_2$ being in the range of 0-20°, preferably 0-10°, and more preferably 2°-7°. Due to the second perpendicular angle, the secondary oxidant sprayed from the secondary oxidant nozzle deviates toward the primary oxidant-fuel delivery component. The second perpendicular angle refers to the angle between the central axis of the secondary oxidant nozzle and the axial direction of the burner body, when the secondary oxidant nozzle is projected onto the XZ plane perpendicular to the XY plane in which the primary oxidant-fuel delivery component lies.

Further, at least one said secondary oxidant supply channel is arranged to be coaxial with the secondary oxidant nozzle at the end thereof, and has the second perpendicular angle $\beta_2$.

Further, the secondary oxidant delivery component further comprises: a second adjusting connection member, used to connect the secondary oxidant supply channel to the secondary oxidant nozzle thereof, and adjust the second horizontal spread angle $\alpha_2$ and/or the second perpendicular angle $\beta_2$ of the secondary oxidant nozzle. The second adjusting connection member may comprise but is not limited to a universal joint, a corrugated pipe or a similar connection mechanism; these allow the secondary oxidant supply channel to be attached to the secondary oxidant nozzle, and can rotate within a certain range so as to allow the fuel nozzle to have a preferred or default second horizontal spread angle $\alpha_2$ and/or second perpendicular angle $\beta_2$.

Further, at least one said tertiary oxidant nozzle is provided with a third perpendicular angle $\beta_3$ of deviation toward the primary oxidant-fuel delivery component, the angle $\beta_3$ being in the range of 0-20°, preferably 0-9°. Due to the third perpendicular angle, the tertiary oxidant sprayed from the tertiary oxidant nozzle deviates toward the primary oxidant-fuel delivery component. The third perpendicular angle $\beta_3$ refers to the angle between the central axis of the tertiary oxidant nozzle and the axial direction of the burner body, when the tertiary oxidant nozzle is projected onto the XZ plane perpendicular to the XY plane in which the primary oxidant-fuel delivery component lies.

Further, at least one said tertiary oxidant supply channel is arranged to be coaxial with the tertiary oxidant nozzle at the end thereof, and has the third perpendicular angle.

Further, the tertiary oxidant delivery component further comprises: a third adjusting connection member, used to connect the tertiary oxidant supply channel to the tertiary oxidant nozzle thereof, and capable of adjusting the third horizontal spread angle $\alpha_3$ and/or the third perpendicular angle $\beta_3$ of the tertiary oxidant nozzle as required. The third adjusting connection member may comprise but is not limited to a universal joint, a corrugated pipe or a similar connection mechanism; these allow the tertiary oxidant supply channel to be attached to the tertiary oxidant nozzle, and can rotate within a certain range so as to allow the fuel nozzle to have a preferred or default third horizontal spread angle $\alpha_3$ and/or third perpendicular angle $\beta_3$.

Further, the burner further comprises an oxidant staging control mechanism for independently controlling oxidant flow rates in the primary oxidant supply channel, secondary oxidant supply channel and tertiary oxidant supply channel.

Further, the primary oxidant-fuel delivery component, secondary oxidant delivery component and tertiary oxidant delivery component are integrated in the same burner block body, or distributed in different burner block bodies and fitted together.

Further, the primary oxidant-fuel delivery component, secondary oxidant delivery component and tertiary oxidant delivery component are arranged in order from bottom to top.

Further, the fuel nozzle, annular nozzle, secondary oxidant nozzle and tertiary oxidant nozzle are each any one of a circular, oval, square or irregular shape.

Further, in the primary oxidant-fuel delivery component, the at least one fuel supply channel is configured to comprise a first fuel supply channel and a second fuel supply channel, the first fuel supply channel being nested within the corresponding second fuel supply channel, wherein the first fuel and second fuel are each independently selected from solid fuels, liquid fuels or gaseous fuels.

In a second aspect of the present invention, a combustion method of a burner for fuel combustion is provided, using a flame formed by at least one burner as described above, the method comprising:

guiding in a fuel and a primary oxidant surrounding the fuel through the primary oxidant-fuel delivery component, so that the fuel and primary oxidant are injected into a combustion space together after mixing in the vicinity of the front end face of the burner body, the amount of primary oxidant supplied being less than an oxidant amount needed to completely burn the fuel, so as to produce a primary mixture of a primary combustion product and incompletely burned fuel;

guiding in a secondary oxidant through the secondary oxidant delivery component, so that the primary mixture and secondary oxidant come into contact and mix with each other at a set position, burning to produce a secondary mixture;

guiding in a tertiary oxidant through the tertiary oxidant delivery component, so that the tertiary oxidant comes into contact and mixes with the secondary mixture, burning to form a final combustion product.

Further, the primary oxidant accounts for 1-20%, preferably 1-15%, and optimally 2-5% of a total oxidant flow rate, in terms of ratios of volume flow rates; the secondary oxidant flow rate accounts for 5-70%, preferably 10-50%, and optimally 15-30% of the total oxidant flow rate, in terms of ratios of volume flow rates; and the tertiary oxidant flow rate accounts for 5-90%, preferably 20-80%, and optimally 50-75% of the total oxidant flow rate, in terms of ratios of volume flow rates.

Further, the ejection speed of the primary oxidant is set to 0.5-30 m/s, the ejection speed of the fuel is set to 5-130 m/s, the ejection speed of the secondary oxidant is set to 2.5-80 m/s, and the ejection speed of the tertiary oxidant is set to 5-160 m/s; and a flame is formed, the flame being used to heat a material being heated.

The burner and combustion method provided by the present invention have the following advantages:

1. In the burner provided by the present invention, the delivery of fuel and oxidant in a highly staged way achieves low NOx emissions and enables control of the atmosphere close to the surface of the material being heated.

2. Through adjustment of the speed, flow rate and distribution of each staged oxidant, the burner provided by the present invention can better control the degree of dilution of hot smoke and oxidant in the melting furnace, adjust the flame length and rigidity, and adjust the flame coverage region.

3. The burner can effectively control the temperature in the furnace, avoiding undesired local overheating.

4. The burner can enhance the thermal efficiency and yield, helping to form stronger convection in the material being heated, promoting more complete elimination of impurities, and improving product quality.

5. The burner can reduce costs, and can be easily manufactured as an integrated burner, thus reducing the space taken up by the burner.

BRIEF DESCRIPTION OF THE DRAWINGS

Further understanding of the advantages and spirit of the present invention can be gained through the following detailed description of the invention and the attached drawings.

Figure 1A:
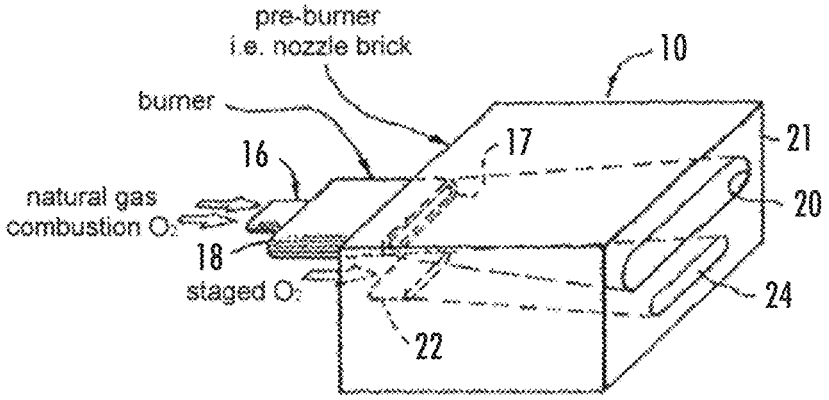
FIG. 1A is a schematic drawing showing the layout of a staged burner disclosed in the Chinese patent with Patent Number. CN1134610C.

Key to the drawings: burner body 1, burner block 2, burner metal member 3, primary oxidant-fuel delivery component 10, fuel supply channel 11, fuel nozzle 111, primary oxidant supply channel 12, annular nozzle 121, secondary oxidant delivery component 20, secondary oxidant supply channel 21, secondary oxidant nozzle 211, tertiary oxidant delivery component 30, tertiary oxidant supply channel 31, tertiary oxidant nozzle 311, first fuel spraying pipeline 422, first fuel inlet end 426, second fuel inlet end 427, fuel outlet end 424, second fuel spraying pipeline 425.

PREFERRED EMBODIMENTS OF THE INVENTION

The technical solution of the present invention will be clearly and completely described below in conjunction with the accompanying drawings. Obviously, the described embodiments are some of the embodiments of the present invention, rather than all of the embodiments. Based on the embodiments of the present invention, all other embodiments obtained by those of ordinary skill in the art without creative work shall fall within the protection scope of the present invention.

In the description of the present invention, it must be explained that orientational or positional relationships indicated by terms such as "up", "down", "left", "right", "vertical", "horizontal", "inner" and "outer" are based on the orientational or positional relationships shown in the drawings, and are merely simplified descriptions intended to facilitate the description of the present invention, without indicating or implying that the apparatus or element referred to must have a specific orientation or be constructed and operated in a specific orientation, and therefore must not be understood as limiting the present invention. In addition, the terms "first", "second" and "third" merely serve a descriptive purpose, and must not be understood as indicating or implying relative importance.

In the description of the present invention, it must be explained that unless otherwise clearly specified and defined, the terms "installed", "connected together" and "connected" should be understood in a broad sense, e.g. may mean connected in a fixed manner, but may also mean removably connected, or integrally connected; may mean mechanically connected; may mean directly connected together, but may also mean connected together indirectly via an intermediate medium; and may mean internal communication between two elements. Those skilled in the art can understand the specific meaning of the above terms in the present invention according to the specific circumstances.

Unless clearly indicated otherwise, each aspect or embodiment defined here can be combined with any other aspect(s) or embodiment(s). In particular, any preferred or advantageous feature indicated can be combined with any other preferred or advantageous feature indicated.

As used herein, the expression "the axial direction of the burner body" means a direction substantially parallel to a rotation axis, symmetry axis or center line of the burner body, roughly meaning the direction of delivery of fuel in a primary oxidant-fuel delivery component. For example, in the XY plane shown in FIG. 13, the direction along or parallel to the X axis is the axial direction of the burner body. Correspondingly, the Y axis direction can be determined as meaning a direction orthogonal to the X axis. Correspondingly, the Z axis direction can be determined according to the right-hand rule.

As used herein, the expression "the outside of the burner body" means a direction of outward extension away from the center of the burner body, when the burner body is considered as a whole.

As used herein, the expression "around" or "surrounding" essentially means forming a ring shape, roughly meaning that an inner ring is enclosed within an outer ring, so that a certain gap exists between an inner layer and an outer layer. This gap may be an annular gap or a non-annular gap. As used here, this could mean that a primary oxidant supply channel surrounds a part of the circumference (e.g. more than half) of a fuel supply channel, or that the primary oxidant supply channel surrounds all of the circumference of the fuel supply channel. The latter case can be interpreted as meaning that the primary oxidant supply channel is arranged in such a way as to completely surround the circumference of the fuel supply channel in the circumferential direction. The design of a fuel nozzle and annular nozzle can be understood in a similar way.

As used herein, the expression "staging" means that the fuel and oxidant are mixed at different times and at different positions, making it possible to achieve low emissions of nitrogen oxides and control of the gas atmosphere close to the surface of the molten material. The meaning of staging is that the oxidant can be supplied at a different ratio or flow speed via another nozzle spaced apart from the fuel nozzle. For example, when the staging of secondary oxidant and tertiary oxidant is 95%, this means that the remaining 5% of the oxidant is supplied with fuel to the primary oxidant-fuel delivery component.

As used herein, the expression "fuel" means gaseous, liquid or solid fuels that can be used in place of one another or used in combination. The gaseous fuel may be natural gas (mainly methane), propane, hydrogen or any other hydrocarbon compound and/or sulfur-containing compound. The solid or liquid fuel may mainly be any compound in a carbon-containing and/or hydrocarbon and/or sulfur-containing form. Those skilled in the art can decide the way in which the gaseous, liquid or solid fuel is introduced as required; it is not the intention of the present invention to impose any limitations in this regard. Some of the data presented herein uses natural gas as fuel, but the results are considered to be suitable for other fuels, e.g. hydrogen and other gaseous fuels.

As used herein, the expression "oxidant" may be composed of an oxidant such as air or oxygen-rich air. The oxidant stream is preferably composed of an oxidant with a molar oxygen concentration of at least 50%, preferably at least 80%, more preferably at least 90% and most preferably at least 95%. These oxidants include oxygen-enriched air containing at least 50% oxygen by volume, such as 99.5% pure oxygen produced by a cryogenic air separation plant, or non-pure oxygen (88% or more by volume) produced by a vacuum pressure swing adsorption process, or oxygen produced by any other source.

The use of oxygen-containing fuel herein can eliminate nitrogen in the melting operation and reduce NOx and particulate emissions to below the standard. The use of an oxy-fuel burner can achieve different flame momenta, melt coverage rates and flame radiation characteristics. In the furnace, the main sources of nitrogen are air leakage, low-purity oxygen supplied from a vacuum pressure swing adsorption or pressure swing adsorption apparatus, nitrogen in the fuel (e.g. natural gas), or nitrogen contained in the melting raw material packed in the furnace.

As used herein, the term "nozzle" can have several different meanings. In general, the nozzle in this specification can be understood as being a conical part at an extremity of an atomization jetting system, a sprayed mist being ultimately ejected from the conical part at the extremity. See for example the definition of nozzle in Merriam Webster's Dictionary: a short tube with a taper or constriction used (as on a hose) to speed up or direct a flow of fluid. The "nozzles" in this specification refer to components that are located at an end of the burner and supply fuel and oxidant so that they burn.

As used herein, the fuel supply channel, primary oxidant supply channel, secondary oxidant supply channel and tertiary oxidant supply channel may be substantially annular channels, and may be a region having an inlet and an outlet. When viewed from a cross section of a plane perpendicular to an axial flow direction, each of the substantially annular channels is preferably annular, but this shape can also be non-annular.

As used herein, the expression "combustion face" can be understood as being established on a front end face of a burner block; an annular nozzle, secondary oxidant nozzle and tertiary oxidant nozzle can terminate at this combustion face.

Figure 4:
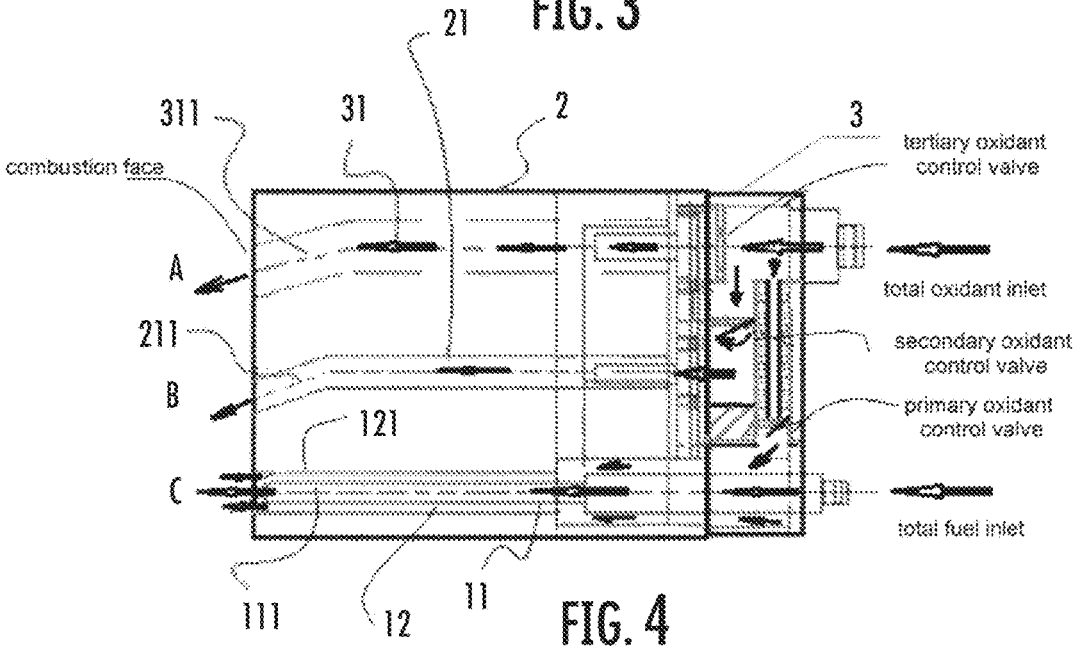
FIG. 4 is a schematic drawing of a cross section (in the direction of the XZ plane) of an exemplary burner having a total fuel inlet and a total oxidant inlet according to the present invention.

FIG. 4 shows a schematic drawing of a cross section (XZ cross section) of an exemplary burner having a total fuel inlet and a total oxidant inlet according to the present invention. A burner metal member 3 may be a metal body inserted into a substantially cuboid-shaped burner block 2; these together form a part of the burner body. The burner metal member 3 is provided with the total fuel inlet, the total oxidant inlet, an oxidant staging control mechanism and separate channels. The oxidant staging control mechanism and separate channels can allow fuel or oxidant to be delivered proportionally to a fuel supply channel 11, a primary oxidant supply channel 12, a secondary oxidant supply channel 21 and a tertiary oxidant supply channel 31.

Fuel is delivered to the fuel supply channel 11 via the total fuel inlet; the fuel supply channel 11 terminates at a fuel nozzle 111. The fuel nozzle 111 may have a circular cross section, or may have a non-circular cross section having a certain length to width ratio. All of the oxidant is delivered to the burner metal member 3 via the total oxidant inlet; the oxidant staging control mechanism in the burner metal member distributes the total oxidant proportionally to at least one of the primary oxidant supply channel 12, secondary oxidant supply channel 21 and tertiary oxidant supply channel 31. The primary oxidant supply channel 12 for primary oxidant flow as shown in FIG. 4 surrounds an outer wall of the fuel supply channel 11, and is coaxial with the fuel supply channel 11. An annular nozzle 121 surrounding the fuel nozzle 111 is provided at one end of the primary oxidant supply channel 12.

The oxidant staging control mechanism may be a staging distribution valve, and may be fitted in the burner metal member of the burner, the function thereof being to transfer staged portions of oxidant from the burner metal member into each oxidant supply channel for distribution. The oxidant staging control mechanism may comprise a primary oxidant control valve, a secondary oxidant control valve and a tertiary oxidant control valve.

The fuel supply channel may be a fuel conduit formed of a suitable material (e.g. high-temperature-resistant metal or ceramic). A starting end of the fuel conduit is removably connected to the burner metal member, but may also be integrally formed therewith. An outlet end of the fuel conduit is connected to the fuel nozzle. The oxidant supply channels may be oxidant supply conduits formed of a specific material (e.g. high-temperature-resistant metal or ceramic), but may also be shape-fitting cavities or channels formed in the burner block. In the latter case, the burner metal member is inserted into starting regions of the corresponding cavities or channels of the burner block, such that the oxidant flows in these cavities or channels.

A secondary oxidant delivery component 20 comprises the secondary oxidant supply channel 21 for secondary oxidant flow; a secondary oxidant nozzle 211 is provided at an end thereof.

A tertiary oxidant delivery component 30 comprises the tertiary oxidant supply channel 31 for tertiary oxidant flow; a tertiary oxidant nozzle 311 is provided at an end thereof.

The fuel supply channel 11, secondary oxidant supply channel 21 and tertiary oxidant supply channel 31 are arranged in order from bottom to top in the Z axis direction.

The total oxidant can be split into three streams: a primary oxidant stream, a secondary oxidant stream and a tertiary oxidant stream. The primary oxidant stream surrounds the fuel nozzle, and the volume flow rate thereof accounts for only a very small proportion of the total oxidant, preferably less than 20% or less than 10% or less than 5% or about 2%-5%. The remaining oxidant serves as the secondary oxidant stream and tertiary oxidant stream. This will be respectively equivalent to a preferred staging proportion of at least 10% or at least 20% or at least 40% or at least 50% or at least 60% or even at least 70%. This means that a sufficient quantity of oxidant flows through the secondary oxidant supply channel or tertiary oxidant supply channel, or is distributed between the two supply channels, for staging. This not only reduces the production of NOx, but also significantly increases the capacity for controlling the gas atmosphere adjacent to the melting surface of the material being heated. In order to be able to control the atmosphere close to the melting surface, for oxidation or reduction selectively according to the process situation, it is desired that the operation of the burner can be switched conveniently. For this purpose, the oxidant flow rates (i.e. streams) in the primary, secondary and tertiary oxidant supply channels can be independently controlled by means of the oxidant staging control mechanism. The oxidant streams are all independent of each other, thus precise control of combustion can be achieved.

It should be pointed out that it is not ideal for the primary oxidant stream to be zero; this would give rise to a void or vacuum in the primary oxidant supply channel, thus sucking in hot corrosive furnace gas, which would destroy the burner very quickly as well as causing flame instability. Furthermore, if the primary oxidant stream is too small, then the flame stability will also fall; moreover, the state of mixing of the gaseous fuel and oxidant will deteriorate, so that a flame of practical use is difficult to obtain. In certain situations, the secondary oxidant stream or tertiary oxidant stream may be close to zero; in this case, the burner is essentially approaching or equivalent to a double-staged burner, and the corresponding combustion effect and characteristics can be predicted and adjusted according to the knowledge of those skilled in the art.

As an example, the annular nozzle 121 surrounds the fuel nozzle 111, and an outlet end of the annular nozzle 121 can terminate at a front end face of the burner body, to form a flame for heating the material being heated; the front end face of the burner body may also be called the "combustion face" or "hot face". An outlet end of the fuel nozzle 111 can be sunk into the combustion face by about 2 cm-5 cm; such a configuration allows the fuel and primary oxidant to form a more stable flame after mixing in the vicinity of the combustion face.

Figure 5:
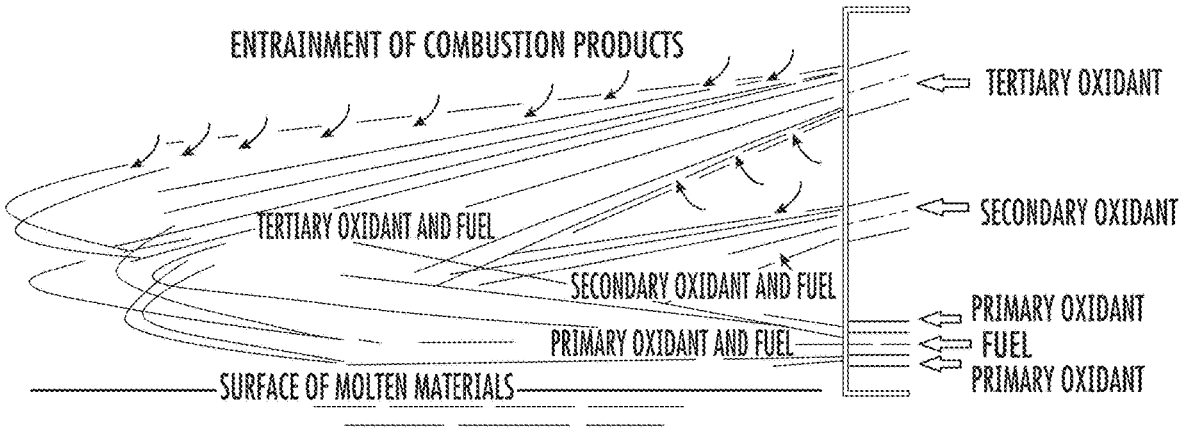
FIG. 5 shows a schematic diagram of the burner of the present invention.

FIG. 5 shows a schematic diagram of the burner of the present invention. Metallurgical furnaces for metals, etc. or industrial furnaces such as glass melting furnaces generally have the material being heated, such as melting raw material, placed in a lower region of the furnace interior, with the flame being formed in an upper space in the furnace, and the material being heated is heated or melted by thermal radiation from the flame.

In this embodiment, the tertiary oxidant and secondary oxidant are located above the same side of the fuel-primary oxidant. In general, the primary oxidant and secondary oxidant come into contact with the fuel stream before the tertiary oxidant, forming a fuel-rich flame and producing a fuel-rich combustion mixture, which might contain a portion of combustion products, unreacted fuel and oxidant, etc. Soot production is enhanced by pyrolysis of these fuel-rich combustion mixtures, which is more conducive to the formation of a luminous flame.

In certain situations, a glass melting furnace often needs higher flame luminosity; in this case, the secondary oxidant is jetted at a faster speed, so faster combustion will take place. Since this often accelerates the mixing of fuel and oxidant, the flame length is shortened, so that local temperatures rise rapidly. Those skilled in the art know that a desired oxidant jetting speed can be achieved in various ways, and it is not the intention of the present invention to impose limitations in this regard, with no restriction to adjustment of oxidant flow rate, adjustment of oxidant nozzle size and adjustment of oxidant temperature, etc.

In certain situations, for example in aluminum smelting industrial furnaces, a longer flame length is often needed to increase the heat transfer efficiency, and the jetting speed of tertiary oxidant can continue to be increased to a suitable range. The tertiary oxidant ejected at high speed is diluted further in the combustion product mixtures of the previous two stages, with the tertiary oxidant being further entrained in the surrounding mixture atmosphere; this helps to form a longer flame length, while the production of NOx is also further reduced.

Figure 6A:
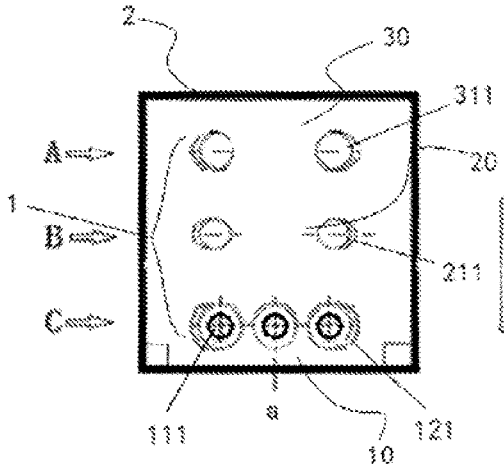
FIG. 6A shows a sectional drawing of each nozzle outlet end of the burner according to the present invention.
Figure 6B:
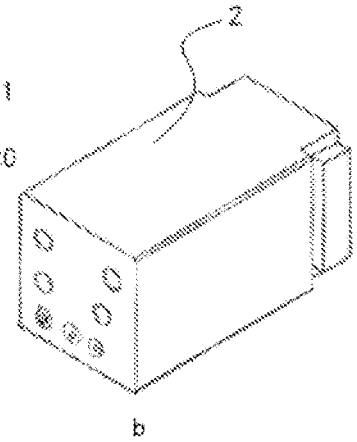
FIG. 6B shows a three-dimensional drawing of the burner.

In FIGS. 6A and 6B, identical reference labels are used for structural parts that are identical to those in the burner shown in FIG. 4. FIGS. 6A and 6B show a typical burner design in a first embodiment of the present invention, wherein FIG. 6A shows a sectional drawing of each nozzle outlet end of the burner, and FIG. 6B shows a three-dimensional drawing of the burner. The burner is divided into three regions; zone A, zone B and zone C. The burner body 1 comprises the primary oxidant-fuel delivery component 10 located in zone C, the secondary oxidant delivery component 20 located in zone B, and the tertiary oxidant delivery component 30 located in zone A. The substantially cuboid-shaped burner block 2 can be made of various refractory materials. The front end face of the burner block 2 can form an end face of the entire burner body.

The primary oxidant-fuel delivery component 10 is spaced apart from the secondary oxidant delivery component 20 and tertiary oxidant delivery component 30. The secondary oxidant delivery component 20 and tertiary oxidant delivery component 30 are arranged at the same side, i.e. an upper side, of the primary oxidant-fuel delivery component 10. Moreover, the secondary oxidant delivery component 20 is located between the tertiary oxidant delivery component 30 and the primary oxidant-fuel delivery component 10.

Each oxidant nozzle can terminate at the combustion face of the burner block 2. The outlet end of the fuel nozzle 111 can be sunk into the combustion face by about 2 cm-5 cm, i.e. can terminate in advance at a certain position remote from the combustion face. Such a configuration allows the fuel and primary oxidant to form a more stable flame after mixing in the vicinity of the combustion face. If it terminates too early, if the distance by which the outlet end of the fuel nozzle is sunk into the combustion face is less than 2 cm, then the mixing time of the fuel and primary oxidant is too short, and the mixing result is poor; if the distance is greater than 5 cm, local overheating caused by excessively fast combustion easily results in the burner being damaged by burning.

Figure 7:
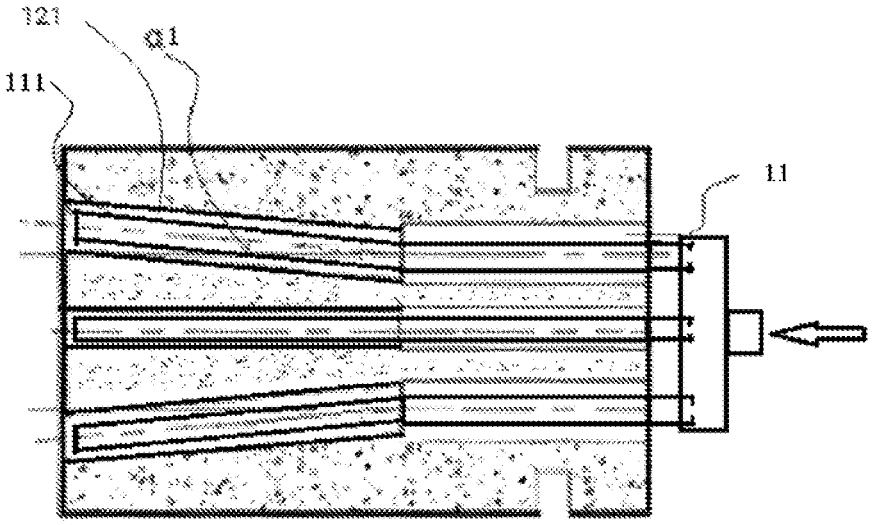
FIG. 7 is a schematic sectional drawing of an exemplary primary fuel-oxidant delivery component according to the present invention in the direction of the XY plane.

FIG. 7 is a schematic sectional drawing of an exemplary primary fuel-oxidant delivery component according to the present invention in the direction of the XY plane. At least one fuel nozzle 111 and an annular nozzle 121 surrounding the fuel nozzle are simultaneously provided with a first horizontal spread angle $\alpha_1$ of deviation toward the outside of the burner body; overall, this causes the fuel sprayed from the fuel nozzle 111 and the primary oxidant sprayed from the annular nozzle 121 to expand toward the outside of the burner body, thus widening the scope of coverage of the flame. The first horizontal spread angle $\alpha_1$ refers to the angle between the central axis of the fuel nozzle 111 and the axial direction of the burner body. Here, the expression "the outside of the burner body" means a side region distant from the center of the burner body. The first horizontal spread angle $\alpha_1$ is 0-20°, preferably 0-10°, and more preferably 3°-6°. When the first horizontal spread angle $\alpha_1$ of a particular fuel nozzle is zero, the direction of fuel sprayed therefrom lies substantially in the axial direction of the burner body.

In one primary oxidant-fuel delivery component, when the primary oxidant supply channel 12 and the annular nozzle 121 are respectively coaxial with the fuel supply channel 11 and the fuel nozzle 111 which they surround, then they have the same first horizontal spread angle $\alpha_1$. Those skilled in the art should know that the fuel nozzle 111 and annular nozzle 121 can be configured to be non-coaxial, as long as it is ensured that the annular nozzle always surrounds the fuel nozzle.

As an example, depending on the circumstances, a configuration is possible in which each fuel nozzle is provided with a different or identical first horizontal spread angle of deviation toward the outside of the burner body. As an example, the fuel supply channel 11 is arranged to be coaxial with the fuel nozzle 111 at the end thereof, i.e. also has the first horizontal spread angle. Of course, for convenience of manufacture, the fuel supply channel 11 and fuel nozzle 111 may be connected in a fixed manner and integrally formed.

Figure 8:
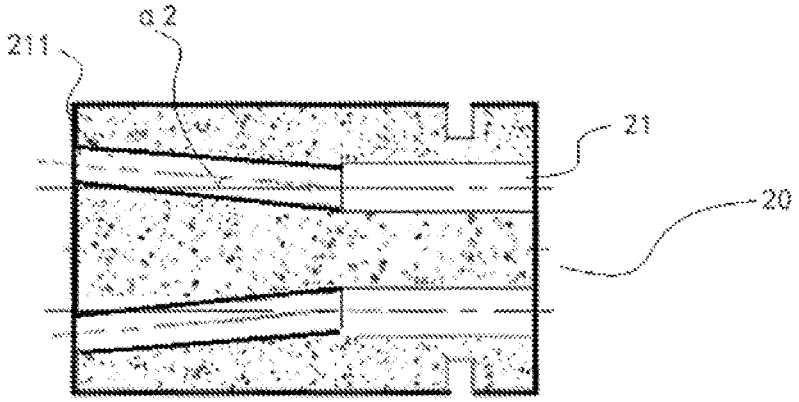
FIG. 8 is a schematic projection of an exemplary secondary oxidant delivery component 20 according to the present invention in the direction of the XY plane.

FIG. 8 is a schematic projection of an exemplary secondary oxidant delivery component 20 according to the present invention in the direction of the XY plane. As shown in FIG. 8, two secondary oxidant nozzles 211 are each provided with a second horizontal spread angle $\alpha_2$ of deviation toward the outside of the burner body, such that a spraying plane of secondary oxidant sprayed from the secondary oxidant nozzles 211 is wider, and the area of coverage of the flame is broader; this is more conducive to the formation of a flat flame. The second horizontal spread angle $\alpha_2$ refers to the angle between the central axis of the secondary oxidant nozzle 211 and the axial direction of the burner body, when the secondary oxidant nozzle 211 is projected onto the XY plane in which the primary oxidant-fuel delivery component lies. Those skilled in the art know that depending on needs, a configuration is possible in which each secondary oxidant nozzle is provided with a different or identical second horizontal spread angle of deviation toward the outside of the burner body.

The range of the second horizontal spread angle $\alpha_2$ is 0-15°, preferably 0°-10°, and more preferably 3°-8°. If the second horizontal spread angle is greater than 15°, the local oxidant concentration will be too low, resulting in incomplete combustion. Optionally, the second horizontal spread angle of the secondary oxidant supply channel 21 and the secondary oxidant nozzle 211 connected thereto can be zero.

As an example, it is also possible for at least one secondary oxidant supply channel 21 to be arranged so as to be coaxial with the secondary oxidant nozzle 211 at the end thereof, with both having the second horizontal spread angle $\alpha_2$.

Figure 9:
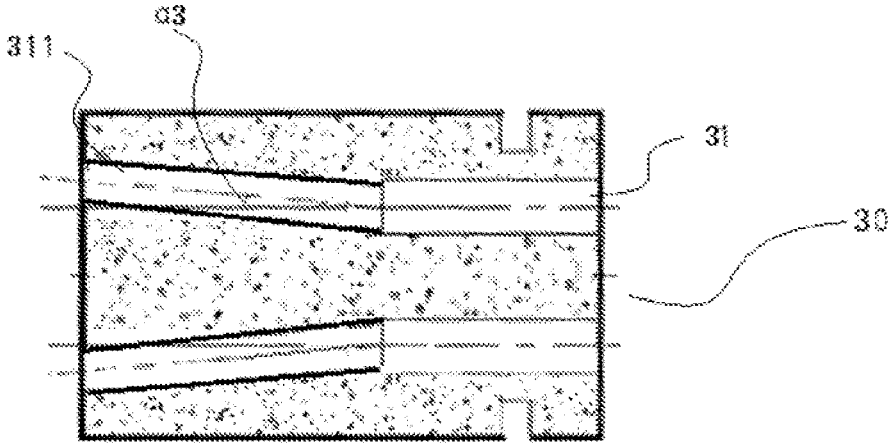
FIG. 9 is a schematic projection of an exemplary tertiary oxidant delivery component 30 according to the present invention in the direction of the XY plane.

FIG. 9 is a schematic projection of an exemplary tertiary oxidant delivery component 30 according to the present invention in the direction of the XY plane. According to the configuration shown in FIG. 9, two tertiary oxidant nozzles 311 are each provided with a third horizontal spread angle $\alpha_3$ of deviation toward the outside of the burner body, such that a spraying plane of tertiary oxidant sprayed from the tertiary oxidant nozzles 311 is wider, and the area of coverage of the flame is larger; this is more conducive to the formation of a flat flame. The third horizontal spread angle $\alpha_3$ refers to the angle between the central axis of the tertiary oxidant nozzle 311 and the axial direction of the burner body, when the tertiary oxidant nozzle 311 is projected onto the XY plane. Those skilled in the art know that depending on needs, a configuration is possible in which each tertiary oxidant nozzle is provided with a different or identical third horizontal spread angle of deviation toward the outside of the burner body.

The range of the third horizontal spread angle $\alpha_3$ is 0-15°, preferably 2°-10°, and more preferably 4°-10°. If the third horizontal spread angle is greater than 15°, the local oxidant concentration will be too low, resulting in incomplete combustion. Optionally, the third horizontal spread angle of the tertiary oxidant supply channel 31 and the secondary oxidant nozzle 311 connected thereto can be zero.

As an example, it is also possible for at least one tertiary oxidant supply channel 31 to be arranged so as to be coaxial with the tertiary oxidant nozzle 311 at the end thereof, with both having the third horizontal spread angle $\alpha_3$.

Figure 10A:
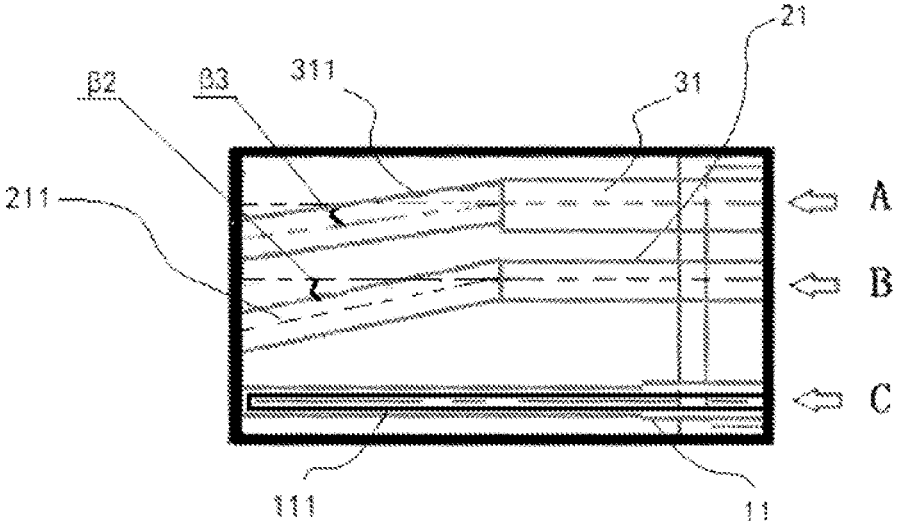
FIG. 10A is a schematic projection of an exemplary burner according to the present invention in the direction of the XZ plane.
Figure 10B:
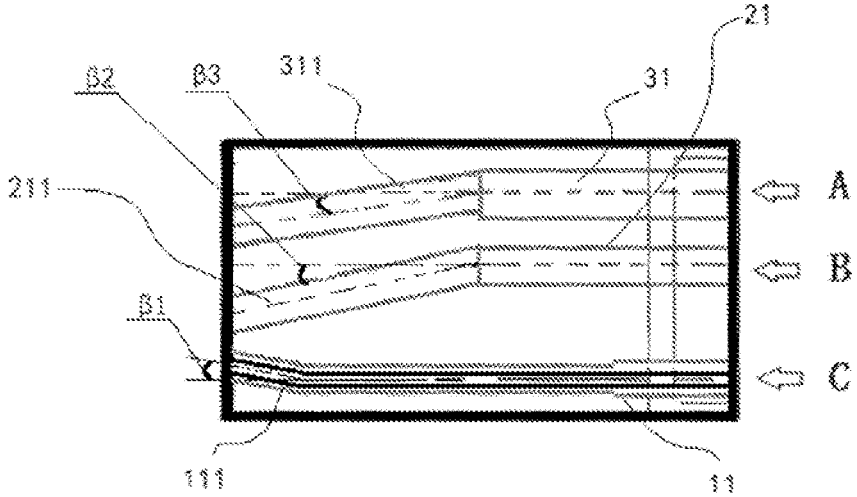
FIG. 10B is a schematic projection of an exemplary burner according to the present invention in the direction of the XZ plane.

FIGS. 10A and 10B are schematic projections of an exemplary burner according to the present invention in the direction of the XZ plane. The range of a first perpendicular angle $\beta_1$ of the fuel nozzle located in zone C is 0-10°, preferably 0-3°. The first perpendicular angle $\beta_1$ refers to the angle between the central axis of the fuel nozzle and the axial direction of the burner body, when the fuel nozzle is projected onto the XZ plane. If $\beta_1$ is zero, this means that the spraying direction of the fuel nozzle is substantially the same as the axial direction of the burner body. If $\beta_1$ is greater than 0°, this enables the spraying direction of the fuel nozzle to be such that overall, the fuel is closer or directed closer to the secondary oxidant nozzle. Setting $\beta_1$ between 0 and 10° is conducive to the spraying direction of the fuel nozzle deviating more toward the secondary oxidant nozzle. If $\beta_1$ exceeds 10°, the secondary oxidant and tertiary oxidant will contact and mix with the fuel too early, so that the necessary flame length cannot be maintained.

Each secondary oxidant nozzle 211 located in zone B is further provided with a different or identical second perpendicular angle $\beta_2$ of deviation toward the primary oxidant-fuel delivery component along the Z axis, such that the secondary oxidant sprayed from the secondary oxidant nozzle 211 deviates toward the primary oxidant-fuel delivery component. The second perpendicular angle refers to the angle between the central axis of the secondary oxidant nozzle 211 and the axial direction of the burner body, when the secondary oxidant nozzle is projected onto the XZ plane perpendicular to the XY plane in which the primary oxidant-fuel delivery component lies. The second perpendicular angle $\beta_2$ is less than 20°, preferably 0-10°, and more preferably 2°-7°. If the second perpendicular angle $\beta_2$ is greater than 20°, the secondary oxidant will contact and mix with the fuel too early, resulting in undesired premature combustion.

Those skilled in the art know that, depending on needs, a configuration is possible in which each secondary oxidant nozzle is provided with a different or identical second perpendicular angle $\beta_2$ of deviation toward the primary oxidant-fuel delivery component along the Z axis. Further, it is also possible for at least one secondary oxidant supply channel 21 to be arranged so as to be coaxial with the secondary oxidant nozzle 211 at the end thereof, with both having the second perpendicular angle $\beta_2$.

The tertiary oxidant nozzles 311 located in zone A are each provided with an identical or different third perpendicular angle $\alpha_3$ of deviation toward the primary oxidant-fuel delivery component, such that the tertiary oxidant sprayed from the tertiary oxidant nozzles 311 deviates toward the primary oxidant-fuel delivery component. The third perpendicular angle refers to the angle between the central axis of the tertiary oxidant nozzle and the axial direction of the burner body, when the tertiary oxidant nozzle 311 is projected onto the XZ plane perpendicular to the XY plane in which the primary oxidant-fuel delivery component lies.

The third perpendicular angle $\alpha_3$ can be 0°-20°, preferably 0°-9°. If $\beta_3$ is greater than 20°, the tertiary oxidant will contact and mix with the fuel too early, so that the flame length cannot be maintained, and the flame will not spread out further in the plane of the melting surface to form an effective heating flame.

Further, depending on the circumstances, a configuration is possible in which each tertiary oxidant nozzle 311 is provided with a different or identical third perpendicular angle of deviation toward the primary oxidant-fuel delivery component along the Z axis.

Further, it is also possible for at least one tertiary oxidant supply channel 31 to be arranged so as to be coaxial with the tertiary oxidant nozzle 311 at the end thereof, with both having the third perpendicular angle.

Figure 11:
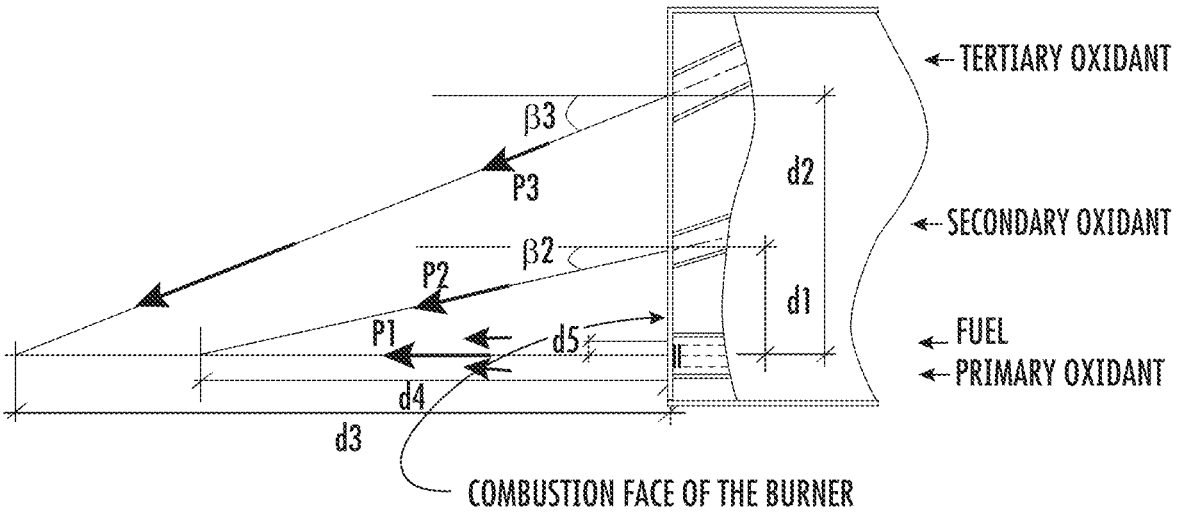
FIG. 11 shows an exemplary schematic sectional drawing of defining angles of the oxidant supply channels according to the present invention.

FIG. 11 shows a schematic sectional drawing of defining angles of the oxidant supply channels. When the secondary oxidant supply channel 21 and tertiary oxidant supply channel 31 are both projected onto the XZ plane in which the primary oxidant-fuel delivery component lies, the positions where lines of extension of the spraying directions of the secondary oxidant nozzle and tertiary oxidant nozzle intersect with the axial direction of the burner body (which can also be understood here to be the axial direction of the primary oxidant-fuel delivery component) are shown, these positions being referred to below as a third intersection position and a second intersection position; the second intersection position will be closer to the burner metal member, i.e. closer to the combustion face, than the third intersection position. Suppose that the direction in which the fuel and primary oxidant are sprayed is P1, the direction in which the secondary oxidant is sprayed is P2, and the direction in which the tertiary oxidant is sprayed is P3.

The following relationship can be used to provide a more visual explanation. The distance $d_3$ (i.e. $d_2/tg\beta_2$) between the third intersection position and the combustion face>the distance $d_4$ (i.e. $d_1/tg\beta_3$) between the second intersection position and the combustion face>the distance $d_5$ between a corresponding intersection position of the primary oxidant supply channel and the combustion face, i.e. $d_3>d_4>d_5$. $d_1$ denotes the distance between the center of the secondary oxidant supply channel and the center of the fuel supply channel; $d_2$ denotes the distance between the center of the tertiary oxidant supply channel and the center of the fuel supply channel.

Purely as an example, three primary oxidant/fuel delivery components, two secondary oxidant delivery components and two tertiary oxidant delivery components may be provided in one burner; those skilled in the art will know that the corresponding number of each component, as well as the parameters of each component, can be selected according to the size of the industrial furnace, the type of melting material and the flame control requirements, etc.

The cross-sectional shape of each oxidant supply channel can be different, and can have a circular, oval, square or irregular shape, etc. Further, the fuel nozzle, annular nozzle, secondary oxidant nozzle and tertiary oxidant nozzle are each any one of a circular, oval, square or irregular shape.

A refractory brick material or another high-temperature-resistant alloy material may be selected as the material of the burner block. The oxy-fuel burner can be used in various industrial fields, e.g. fields such as non-ferrous metals (such as the aluminum industry), glass, cement and ceramics. The burner can produce a flame whose lower region is a neutral or reducing atmosphere, and further, the area of flame coverage is large, the flame length is longer, the flame temperature is more uniform, and local hot points in the flame are not prominent; for these reasons, the burner is especially suited to metallurgical furnaces for non-ferrous metals (such as aluminum smelting), etc.

The oxidant and fuel of the burner of the present invention will come into contact and mix with each other in a suitable manner inside the furnace to accomplish the process of combustion:

1) The fuel supply channel at one side (e.g. a lower part) of the burner is surrounded by the primary oxidant supply channel, wherein the primary oxidant accounts for only a very small proportion of the total oxidant. After mixing in the vicinity of the front end face of the burner body, the fuel and primary oxidant are injected into a combustion space together, to produce a primary mixture of a primary combustion product and incompletely burned fuel.

2) The primary mixture of the primary combustion product and incompletely burned fuel from the above step will first meet secondary oxidant at a suitable position, producing a secondary mixture. The rate of combustion after this meeting is controlled jointly by the flow speed of each stream and the stoichiometric ratio of fuel/oxidant.

3) Tertiary oxidant is sprayed from another oxygen supply channel at another side (e.g. an upper part) of the burner, and after contacting the secondary mixture, undergoes combustion and forms a final combustion product.

The secondary oxidant and tertiary oxidant can mix with the fuel from a predetermined angle at an expected position, and this enables control of the flame temperature and flame luminosity, as well as control of the combustion rate and reduced production of nitrogen oxides (NOx).

With regard to the various streams used in the burner, the ejection speed range of fuel can be set to 5-130 m/s, the ejection speed range of primary oxidant can be set to 0.5-30 m/s, the ejection speed range of secondary oxidant can be set to 2.5-80 m/s, and the ejection speed range of tertiary oxidant can be set to 5-160 m/s. A suitable burner power load range is 0.6-5 MW.

In embodiments of the present invention, the fuel may be a solid fuel, a gaseous fuel or a liquid fuel. The solid fuel can be selected from petroleum coke, coal powder, biomass particles or another fossil fuel, and the solid fuel generally requires a carrier gas (such as air or carbon dioxide) to form a delivery wind for delivery. The liquid fuel can be selected from liquid hydrocarbons or coal tar. The gaseous fuel can be selected from natural gas, hydrogen or another hydrocarbon gas. The entire text of the Chinese invention patent with Patent Number. CN109489038B and title "Burner capable of adjusting feed ratios of multiple fuels" is hereby incorporated herein by reference. The burner of the present invention can also be provided with multiple fuels, and adjust the feed ratio of each fuel to control the combustion result. Especially suitable for using hydrogen as a gaseous fuel, the present invention can alter the flame blackness considerably by introducing a solid or liquid fuel in a controlled amount at the center of the hydrogen fuel, markedly improving the effectiveness of the flame in terms of direct heat transfer to the melting surface as well as reducing the water content of combustion waste gases.

Figure 17:
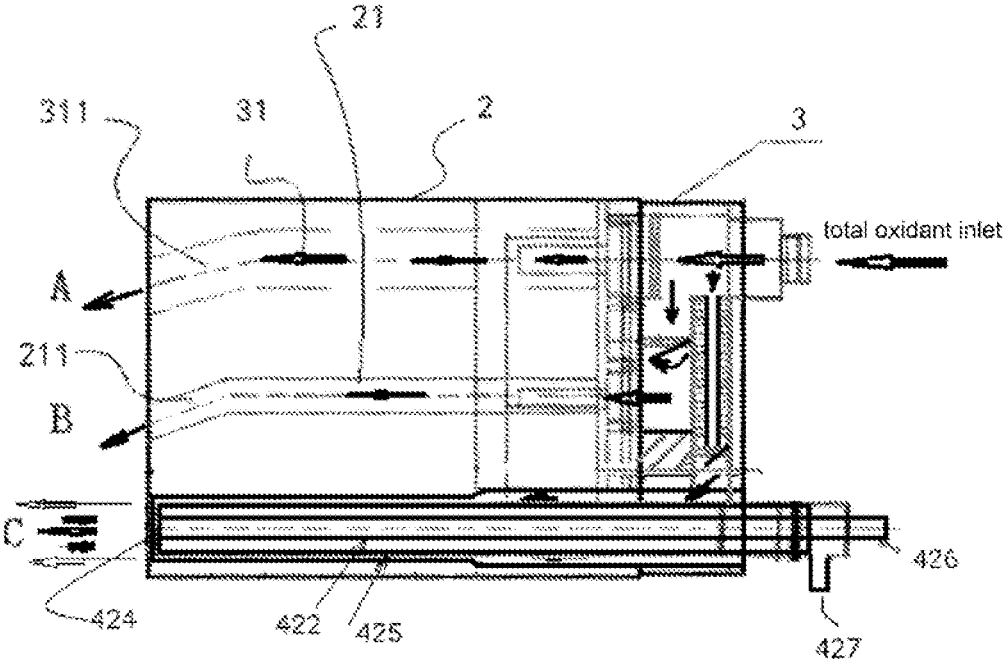
FIG. 17 shows a schematic drawing of an exemplary burner provided with multiple fuel nozzles according to the present invention.

An example is shown in FIG. 17, wherein a first fuel inlet end 426 and a second fuel inlet end 427 can introduce different types of fuel. Each first fuel spraying pipeline 422 is nested within each corresponding second fuel spraying pipeline 425. A first fuel and a second fuel are finally both sprayed through a fuel outlet end 424. The first fuel and second fuel flow in their respective pipelines, wherein the second fuel can flow in an annular pipeline defined by an outer wall of the first fuel spraying pipeline and an inner wall of the second fuel spraying pipeline.

The first fuel may be a solid fuel, a gaseous fuel or a liquid fuel. The solid fuel can be selected from petroleum coke, coal powder, biomass particles or another fossil fuel, and the solid fuel generally requires a carrier gas form to form a wind powder for delivery. The liquid fuel can be selected from liquid hydrocarbons or coal tar. A gaseous fuel stream surrounds the solid fuel annularly, and can increase the flame brightness and improve the combustion result. In general, a fuel with a high ignition point (e.g. a conventional liquid fuel or solid fuel) or a high calorific value will be used as the first fuel. When gas produced from biomass or gas produced from coal is used, this type of unstable fuel with a rather low calorific value tends to be used as the second fuel, while natural gas with a high calorific value is selected as the first fuel.

The second fuel may be a gaseous fuel. When hydrogen is used as the second fuel, due to the characteristics of the hydrogen flame, the flame is barely visible in the high-temperature furnace; when a solid fuel or liquid fuel is used as the first fuel located at the center, the blackness of the flame will undergo a very large change, and the effectiveness of the flame in terms of direct heat transfer to the material being heated will be markedly increased.

Embodiment 1

Figure 12:
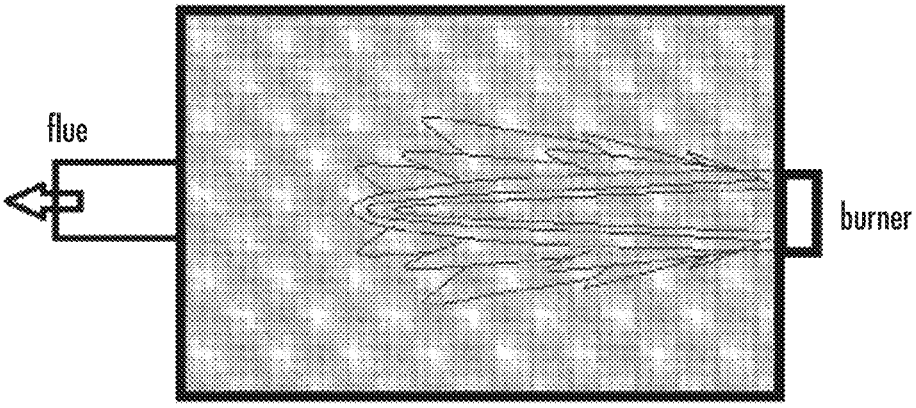
FIG. 12 shows a schematic top view of the burner in a first embodiment of the present invention when installed on an aluminum smelting furnace.

The burner of the present invention is used in an industrial furnace of length 5 m and width 3 m. The combustion rate of the burner is about 500 KW (the common range being 400-700 KW). The burner comprises a primary oxidant-fuel delivery component, a secondary oxidant delivery component and a tertiary oxidant delivery component. FIG. 12 shows a schematic top view of the burner of the present invention when installed on the industrial furnace.

Figure 13:
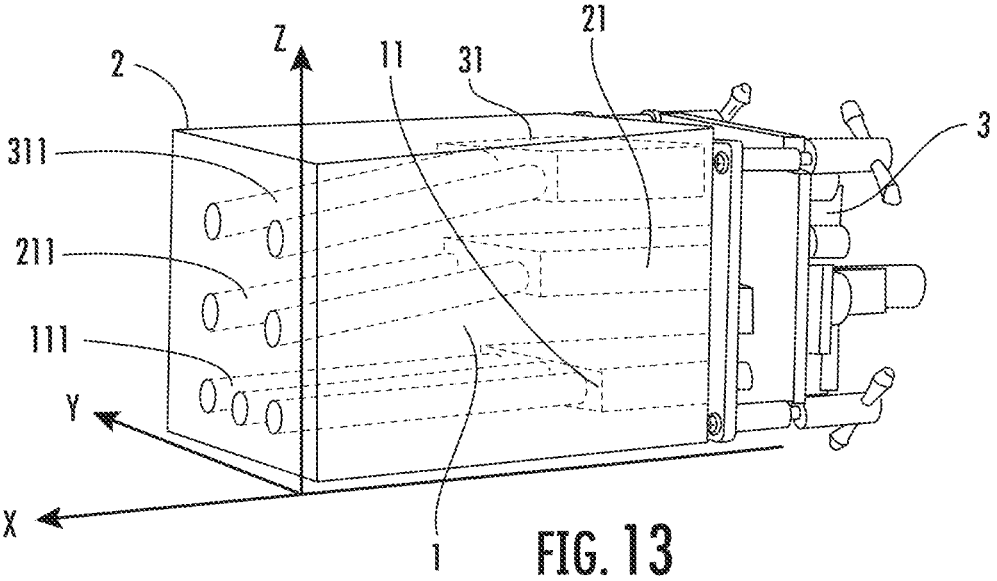
FIG. 13 shows a schematic three-dimensional drawing of the burner in the first embodiment of the present invention.

FIG. 13 shows a schematic three-dimensional drawing of the burner in this embodiment. In the primary oxidant-fuel delivery component, three fuel nozzles 111 are provided; the two fuel nozzles 111 located at the outside have a first horizontal spread angle $\alpha_1$ of 5° toward the outside of the burner body, while the fuel nozzle 111 in the middle position has a first horizontal spread angle of zero. Each annular nozzle is arranged to correspond to the fuel nozzle that it surrounds. In the secondary oxidant delivery component, the second perpendicular angle $\beta_2$ of the two secondary oxidant nozzles 211 is set to 6° toward the fuel nozzles 111, while the second horizontal spread angle $\alpha_2$ is set to 5° toward the outside of the burner.

In the tertiary oxidant delivery component, the third perpendicular angle $\beta_3$ of the two tertiary oxidant nozzles 311 is set to 8° toward the fuel nozzles 111. The third horizontal spread angle $\alpha_3$ is set to 5° toward the outside of the burner.

After entering the burner through the total fuel inlet, the fuel is evenly distributed to three fuel supply channels 11 by the burner metal member 3. After entering through the total oxidant inlet, the oxidant is distributed into the three oxidant delivery components by the oxidant staging control mechanism in the burner metal member 3, and finally injected into the combustion space.

The rate of the combustion reaction is controlled jointly by the speeds of the mixing streams and the stoichiometric ratio of fuel/oxidant. In this embodiment, the primary oxidant accounts for 5% of the total oxidant flow rate; after mixing in the vicinity of the front end face of the burner body, the fuel and primary oxidant are injected into the combustion space. The secondary oxidant accounts for 30% of the total oxidant flow rate, and after being sprayed, meets the primary mixture at some position in the furnace and then mixes therewith. The tertiary oxidant accounts for 65% of the total oxidant flow rate, and after being sprayed, mixes with the mixture from the previous two stages of combustion in the furnace, to complete the process of combustion.

Figure 1B:
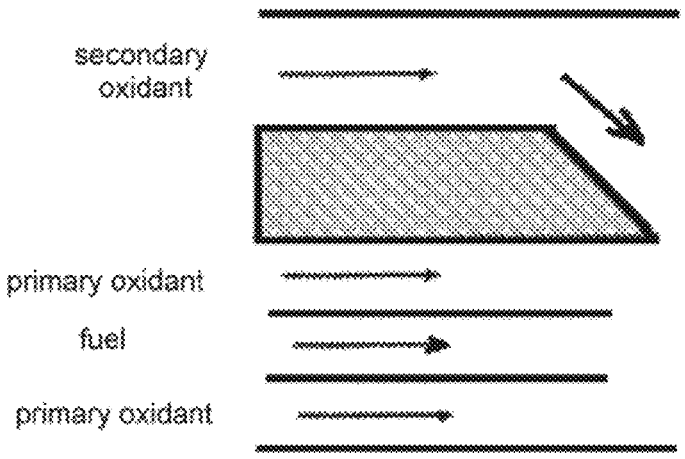
FIG. 1B is a schematic drawing showing the layout of another typical staged burner in the prior art.
Figure 2:
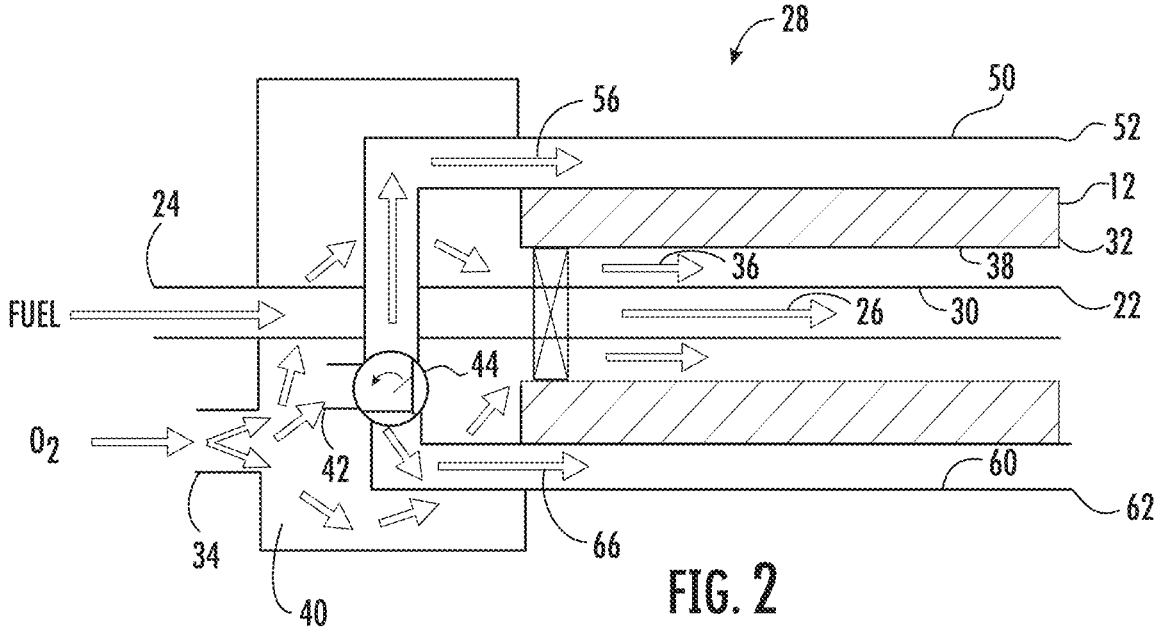
FIG. 2 is a schematic drawing showing the layout of a double-staged oxygen-fuel burner disclosed in the Chinese patent with Patent Number. CN108458339B.
Figure 3:
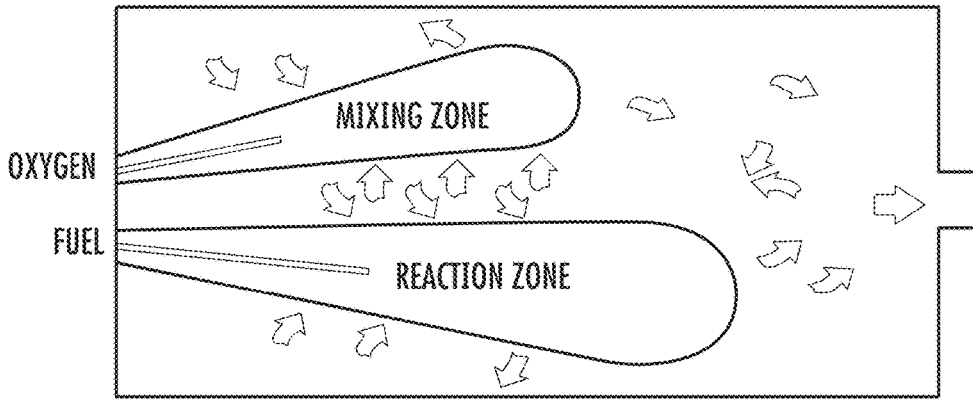
FIG. 3 is a schematic drawing of the ejection states of fuel and oxygen in another dilute oxygen combustion (DOC) burner in the prior art.
Figure 14A:
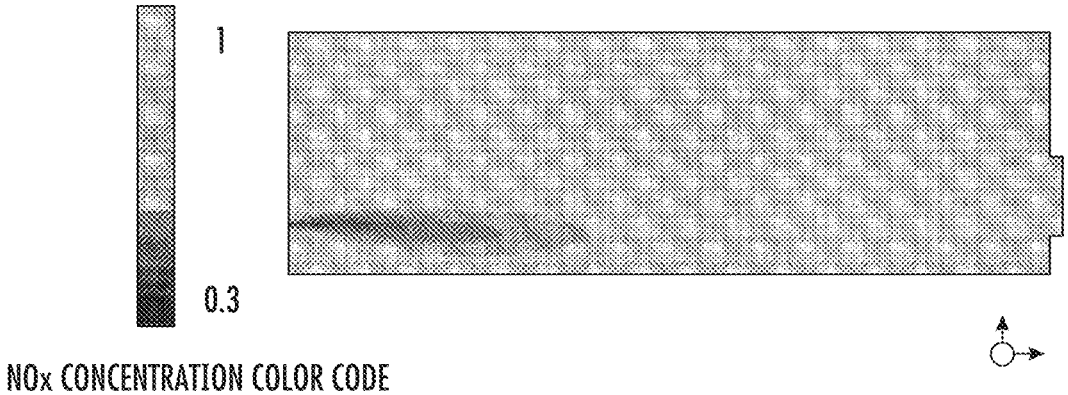
FIG. 14A shows a schematic color code diagram of the NOx concentration distribution produced by the staged burner as shown in FIG. 1B.
Figure 14B:
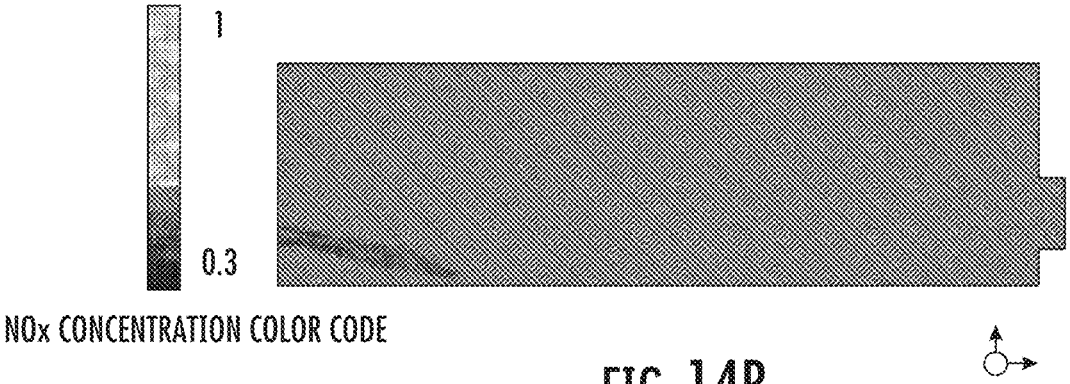
FIG. 14B shows a schematic color code diagram of the NOx concentration distribution produced by the burner in the first embodiment of the present invention when deployed in an aluminum smelting furnace.

FIG. 14B shows the NOx concentration distribution in the abovementioned industrial furnace after normalization; FIG. 14A shows the NOx concentration distribution produced by the staged burner in the prior art as shown in FIG. 1B. The lighter the color of the color code representing the NOx concentration distribution, the higher the concentration of NOx. As can be seen, the NOx concentration is markedly lower when the burner of the present invention is used in the abovementioned industrial furnace. The long flame produced by the burner in this embodiment forms a large area of coverage of the surface of the material being heated, and the flame temperature is uniform overall, without local overheating spots. We can assert that the atmosphere between this type of flame and the material being heated is closer to a reducing atmosphere; this type of flame is especially suitable for aluminum smelting furnaces, being able to transfer heat to aluminum smelting material with high efficiency, and being able to prevent oxidation or volatilization of material due to local overheating, while NOx production is also correspondingly reduced.

Figure 15:
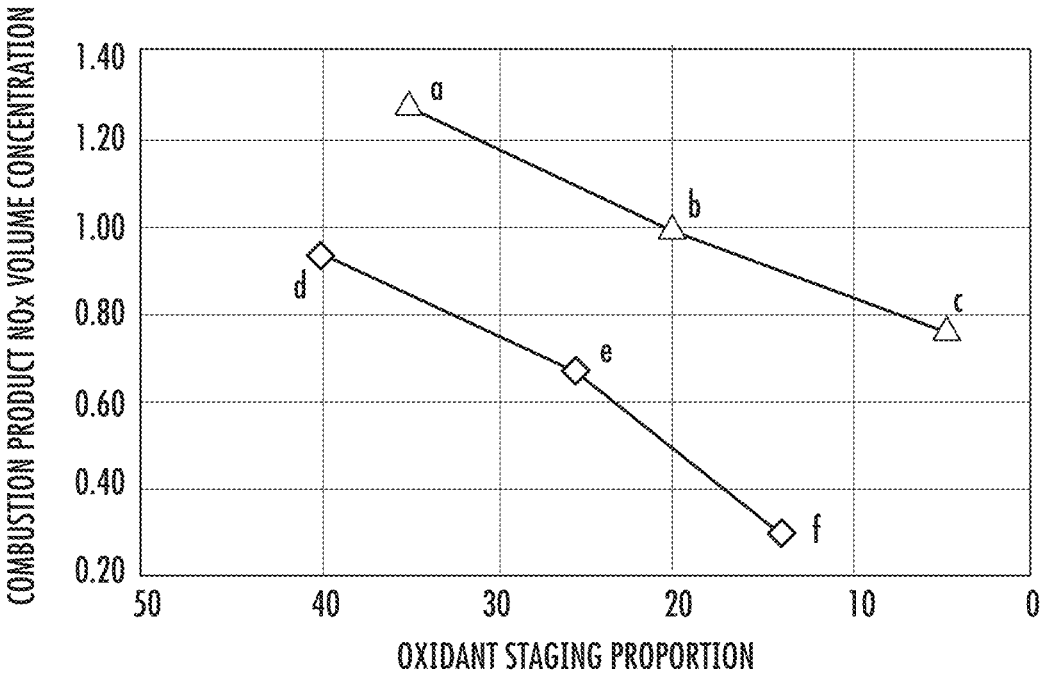
FIG. 15 is a schematic diagram comparing the volume flow rates of nitrogen oxides at the position of an industrial furnace outlet, for the burner in the first embodiment of the present invention and the staged burner as shown in FIG. 1B.

For the staged burner in the prior art as shown in FIG. 1B and the burner in an embodiment of the present invention, different staged oxygen proportions are set and the volume concentrations of NOx in the combustion products are tested, as shown in FIG. 15. Apart from the differences in burner structure, all other conditions are the same, including the dimensions of the combustion space, the maximum temperature of the combustion space, the furnace pressure (measured value of pressure during kiln flame space combustion), the oxygen-fuel ratio and the external environment.

Three sets of tests, a, b and c, were performed using the staged burner as shown in FIG. 1B, setting the proportions of primary oxidant to be about 35%, about 20% and about 5% respectively. After normalization of the results of the three sets of tests a, b and c, the volume concentrations of NOx in the combustion products in the flame region were about 1.30, 1.00 and 0.78 respectively. Three sets of test, d, e and f, were performed using the burner as shown in an embodiment of the present invention, setting the sum of proportions of primary oxidant and secondary oxidant to be about 40%, about 25% and about 15% respectively. After normalization of the results of the three sets of tests d, e and f, the volume concentrations of NOx in the combustion products in the flame region were about 0.91, 0.62 and 0.30 respectively. It can be determined that for similar staging proportions, the production of nitrogen oxides in the burner of the present invention is markedly reduced in the space inside the furnace, especially in the flame region, the extent of the reduction being 30%, 38% and 61% respectively.

When the proportion of primary oxidant is set to be about 35% in the staged burner as shown in FIG. 1B, and the sum of proportions of primary oxidant and secondary oxidant is set to be about 40% in the burner shown in an embodiment of the present invention, the combustion effect achieved is essentially a shorter flame, high brightness and a large flame radiation coefficient.

When the proportion of primary oxidant is set to be about 5% or even lower in the staged burner as shown in FIG. 1B, and the sum of proportions of primary oxidant and secondary oxidant is set to be about 15% or even lower in the burner shown in an embodiment of the present invention, the combustion effect achieved is essentially a longer flame, a large area of flame coverage and good uniformity of flame temperature, with the amount of NOx produced by combustion under these conditions being lower.

When the proportion of primary oxidant is set to 20% in the staged burner as shown in FIG. 1B, and the sum of proportions of primary oxidant and secondary oxidant is set to be about 25% in the burner shown in an embodiment of the present invention, the combustion effect achieved lies between the two situations above.

Compared with the staged burner in the prior art as shown in FIG. 1B, the primary oxidant, secondary oxidant and tertiary oxidant are configured to be successively and gradually further away from the fuel stream; in this way, under the precondition that the primary oxidant and secondary oxidant are guaranteed to undergo preliminary mixing with the fuel stream first so as to stabilize the flame, the fuel-rich incompletely burned substance thus produced mixes with the tertiary oxidant, and undergoes a complete redox reaction, thus achieving a result whereby the area of flame coverage is large, the flame temperature is uniform and NOx emissions are low.

Figure 16:
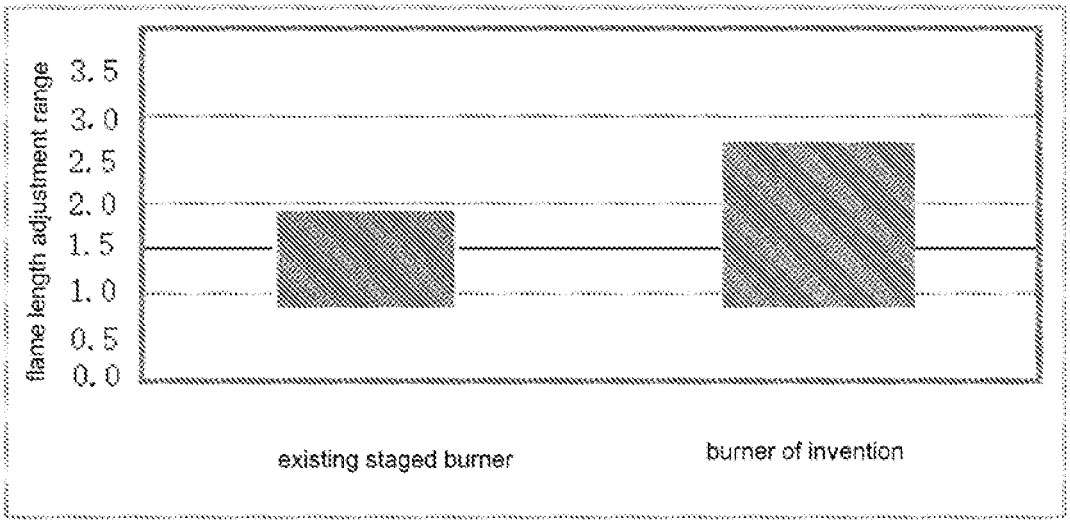
FIG. 16 shows a comparison of the adjustability of in-furnace flame length, for the burner in the first embodiment of the present invention and the staged burner as shown in FIG. 1B.

Taking an experimental furnace of width 3 m as an example, FIG. 16 shows a comparison of the adjustability of in-furnace flame length of the staged burner in the prior art as shown in FIG. 1B and the burner in this embodiment. The same in-furnace pressure was maintained, natural gas was selected as the fuel, and pure oxygen was selected as the oxidant. The burners were arranged on an end wall of an industrial furnace (as shown in FIG. 12); each burner had a combustion rate of about 500 KW. Testing found that the range of flame length adjustment of the staged burner as shown in FIG. 1B was 0.9-1.9 m, while the range of flame length adjustment of the burner in this embodiment was 0.8-2.75 m. As can be seen, the burner provided by the present invention has a wide flame adjustment range, so can meet the needs of different production loads, different raw materials, and production conditions such as product properties when these change.

In summary, the burner provided by the present invention employs a fuel-oxidant combustion technique with a multi-stage configuration. The primary oxidant and secondary oxidant form a fuel-rich flame with the fuel, and soot production is enhanced by pyrolysis of the fuel-rich mixture so as to form a luminous flame. Further reducing the flow rate of primary oxidant and increasing the flow rate (or speed) of secondary oxidant will increase the flame length. Further increasing the speed of tertiary oxidant to a suitable range will form a longer flame length, thereby reducing NOx production, and achieving a higher heat transfer efficiency. By controlling the distribution proportions of primary oxidant, secondary oxidant and tertiary oxidant, the flame length and region of coverage can be adjusted, and a local oxidizing or reducing atmosphere can be controlled, and the flame direction can also be adjusted according to product process requirements.

Although the content of the present invention has been presented in detail by means of the preferred embodiments above, it should be recognized that the descriptions above should not be regarded as limiting the present invention. Various amendments and substitutions to the present invention will be apparent after perusal of the above content by those skilled in the art. Thus, the scope of protection of the present invention should be defined by the attached claims.

The invention claimed is:

1. A burner for fuel combustion, wherein the burner comprises a burner body extending in an axial direction, and a flame for heating a material being heated is formed at a front end face of the burner body, the burner body comprising: a primary oxidant-fuel delivery component, a single secondary oxidant delivery component and a single tertiary oxidant delivery component;

wherein the single secondary oxidant delivery component and single tertiary oxidant delivery component are arranged at the same side of the primary oxidant-fuel delivery component, and the secondary oxidant delivery component is located between the tertiary oxidant delivery component and the primary oxidant-fuel delivery component;

the primary oxidant-fuel delivery component comprises:

at least one fuel supply channel for a fuel to flow through, one end thereof being provided with a fuel nozzle; and at least one primary oxidant supply channel for a primary oxidant to flow through, the primary oxidant supply channel being configured to surround an outer wall of the fuel supply channel, and one end thereof being provided with an annular nozzle surrounding the fuel nozzle;

the secondary oxidant delivery component comprises at least one secondary oxidant supply channel for a secondary oxidant to flow through, one end thereof being provided with a secondary oxidant nozzle;

the tertiary oxidant delivery component comprises at least one tertiary oxidant supply channel for a tertiary oxidant to flow through, one end thereof being provided with a tertiary oxidant nozzle, wherein outlet ends of the secondary oxidant nozzle and the tertiary oxidant nozzle are arranged on the front end face of the burner body and spray the secondary oxidant and tertiary oxidant respectively, and the secondary oxidant mixes with the fuel before the tertiary oxidant.

2. The burner as claimed in claim 1, wherein in the primary oxidant-fuel delivery component, the primary oxidant supply channel is arranged coaxially with the fuel supply channel.

3. The burner as claimed in claim 1, wherein a front end of at least one said fuel nozzle has a first oblique flow path inclined toward the secondary oxidant nozzle.

4. The burner as claimed in claim 1, wherein at least one said fuel nozzle and the annular nozzle surrounding said fuel nozzle are provided with a first horizontal spread angle $\alpha_1$ of deviation toward the outside of the burner body, the first horizontal spread angle $\alpha_1$ being in the range of 0°-20°.

5. The burner as claimed in claim 4, wherein the fuel supply channel is arranged to be coaxial with the fuel nozzle at the end thereof, and has the first horizontal spread angle $\alpha_1$.

6. The burner as claimed in claim 1, wherein a front end of at least one said secondary oxidant nozzle has a second oblique flow path inclined toward the fuel nozzle.

7. The burner as claimed in claim 1, wherein at least one said secondary oxidant nozzle is provided with a second horizontal spread angle $\alpha_2$ of deviation toward the outside of the burner body, the second horizontal spread angle $\alpha_2$ being in the range of 0-15°.

8. The burner as claimed in claim 7, wherein at least one said secondary oxidant supply channel is arranged to be coaxial with the secondary oxidant nozzle at the end thereof, and has the second horizontal spread angle $\alpha_2$.

9. The burner as claimed in claim 1, wherein a front end of at least one said tertiary oxidant nozzle has a third oblique flow path inclined toward the fuel nozzle.

10. The burner as claimed in claim 1, wherein at least one said tertiary oxidant nozzle is provided with a third horizontal spread angle $\alpha_3$ of deviation toward the outside of the burner body, the third horizontal spread angle $\alpha_3$ being in the range of 0-15°.

11. The burner as claimed in claim 10, wherein at least one said tertiary oxidant supply channel is arranged to be coaxial with the tertiary oxidant nozzle at the end thereof and has the third horizontal spread angle $\alpha_3$.

12. The burner as claimed in claim 1, wherein at least one said fuel nozzle is provided with a first perpendicular angle $\beta_1$ of deviation toward the secondary oxidant nozzle, the angle $\beta_1$ being in the range of 0-10°.

13. The burner as claimed in claim 1, wherein at least one said secondary oxidant nozzle is provided with a second perpendicular angle $\beta_2$ of deviation toward the primary oxidant-fuel delivery component, the angle $\beta_2$ being in the range of 0-20°.

14. The burner as claimed in claim 13, wherein at least one said secondary oxidant supply channel is arranged to be coaxial with the secondary oxidant nozzle at the end thereof and has the second perpendicular angle $\beta_2$.

15. The burner as claimed in claim 1, wherein at least one said tertiary oxidant nozzle is provided with a third perpendicular angle $\beta_3$ of deviation toward the primary oxidant-fuel delivery component, the angle $\beta_3$ being in the range of 0-20°.

16. The burner as claimed in claim 15, wherein at least one said tertiary oxidant supply channel is arranged to be coaxial with the tertiary oxidant nozzle at the end thereof and has the third perpendicular angle $\beta_3$.

17. The burner as claimed in claim 1, wherein the burner further comprises an oxidant staging control mechanism for independently controlling oxidant flow rates in the primary oxidant supply channel, secondary oxidant supply channel and tertiary oxidant supply channel.

18. The burner as claimed in claim 1, wherein, in the primary oxidant-fuel delivery component, the at least one fuel supply channel is configured to comprise a first fuel supply channel and a second fuel supply channel, the first fuel supply channel being nested within the corresponding second fuel supply channel, wherein the first fuel and second fuel are each independently selected from solid fuels, liquid fuels or gaseous fuels.

19. A combustion method of a burner for fuel combustion, wherein the burner as claimed in claim 1 is used to form a flame, and the combustion method comprises:

guiding in a fuel and a primary oxidant surrounding the fuel through the primary oxidant-fuel delivery component, so that the fuel and primary oxidant are injected into a combustion space together after mixing in the vicinity of the front end face of the burner body, the amount of primary oxidant supplied being less than an oxidant amount needed to completely burn the fuel, so as to produce a primary mixture of a primary combustion product and incompletely burned fuel;

guiding in a secondary oxidant through the secondary oxidant delivery component, so that the primary mixture and secondary oxidant come into contact and mix with each other at a set position, burning to produce a secondary mixture;

guiding in a tertiary oxidant through the tertiary oxidant delivery component, so that the tertiary oxidant comes into contact and mixes with the secondary mixture, burning to form a final combustion product.

* * * * *